US010092095B2

(12) United States Patent
Zhu

(10) Patent No.: US 10,092,095 B2
(45) Date of Patent: Oct. 9, 2018

(54) COLLAPSIBLE SHOE RACK

(71) Applicant: Shou Qiang Zhu, Ontario, CA (US)

(72) Inventor: Shou Qiang Zhu, Ontario, CA (US)

(73) Assignee: IP Power Holdings Limited, Hong Kong (HK)

( * ) Notice: Subject to any disclaimer, the term of this patent is extended or adjusted under 35 U.S.C. 154(b) by 0 days.

(21) Appl. No.: 15/444,168

(22) Filed: Feb. 27, 2017

(65) Prior Publication Data

US 2017/0245637 A1 Aug. 31, 2017

Related U.S. Application Data

(60) Provisional application No. 62/300,011, filed on Feb. 25, 2016.

(51) Int. Cl.
*A47B 61/04* (2006.01)
*A47B 43/00* (2006.01)

(52) U.S. Cl.
CPC ..... *A47B 61/04* (2013.01); *A47B 43/00* (2013.01)

(58) Field of Classification Search
CPC ..... D06F 57/10; D06F 57/08; D06F 57/06; A47F 7/08; A47F 7/18; A47F 5/13; A47F 5/10; A47B 61/04; A47B 43/00
USPC ..... 211/34, 36, 37, 38, 195, 198, 200, 201
See application file for complete search history.

(56) References Cited

U.S. PATENT DOCUMENTS 57,144 A * 8/1866 Ilgen ..... D06F 57/10 211/202
65,305 A * 5/1867 Titus ..... D06F 57/10 211/202
409,642 A * 8/1889 Little ..... D06F 57/10 211/134
529,439 A * 11/1894 Bent ..... A47F 7/08 211/38
604,875 A * 5/1898 Canedy ..... A47B 61/04 211/149
1,035,552 A * 8/1912 Doering ..... A47F 7/145 108/99
1,039,694 A * 10/1912 Burton ..... A47F 5/13 108/163
1,167,550 A * 1/1916 Forsyth ..... A47F 5/13 108/163
1,231,713 A * 7/1917 Cummings ..... A47F 7/08 211/149
1,874,056 A * 8/1932 Matallana ..... A47B 61/04 211/38
1,927,997 A * 9/1933 Turner ..... A47F 7/08 211/38
2,107,306 A * 2/1938 Pollinger ..... A47F 7/08 211/37

(Continued)

*Primary Examiner* — Patrick D Hawn
(74) *Attorney, Agent, or Firm* — Che-Yang Chen; Law Offices of Scott Warmuth

(57) ABSTRACT

A collapsible shoe rack may include a plurality of shoe retaining members with two parallel side arms integrated with a horizontal arm as a single piece, and a plurality of connecting members with two parallel side arms and a horizontal arm. In one embodiment, the shoe retaining members are arranged in a reverse U-shaped manner in the shoe rack, and each of the shoe retaining members is connected with the connecting member. A locking member is disposed at the base of the shoe rack and pivotally connected to the base at one end, and the connecting member at the other end. The locking unit is configured to lock the entire structure of shoe rack to prevent it from collapsing.

4 Claims, 5 Drawing Sheets

(56) References Cited

U.S. PATENT DOCUMENTS 2,445,403 A * 7/1948 Mayerman ..... D06F 58/14 211/202
4,131,205 A * 12/1978 Malecki ..... D06F 57/10 211/200
4,297,795 A * 11/1981 Licari ..... D06F 57/10 211/198
4,807,766 A * 2/1989 Compagnucci ..... D06F 57/08 211/198
6,105,797 A * 8/2000 Haisma ..... A47F 5/137 211/130.1
6,138,841 A * 10/2000 Klein ..... A47B 81/00 211/113
6,581,786 B1 * 6/2003 King ..... A47F 7/08 211/119
7,172,081 B2 * 2/2007 Trowsdale ..... D06F 57/10 211/200
8,100,274 B2 * 1/2012 Trowsdale ..... D06F 57/08 211/195
8,590,716 B2 * 11/2013 Behjat ..... D06F 57/08 211/195
8,672,147 B2 * 3/2014 Lam ..... A47G 25/0685 211/149
2004/0104190 A1 * 6/2004 Trowsdale ..... D06F 57/10 211/202
2004/0245192 A1 * 12/2004 Hu ..... A47B 45/00 211/34
2007/0138119 A1 * 6/2007 Schwerdlin ..... D06F 57/10 211/202
2009/0178990 A1 * 7/2009 Trowsdale ..... D06F 57/06 211/183
2017/0119152 A1 * 5/2017 Zhu ..... A47B 61/04

* cited by examiner

COLLAPSIBLE SHOE RACK

CROSS-REFERENCE TO RELATED APPLICATIONS

This application claims priority under 35 U.S.C. § 119 (e) to U.S. Provisional Patent Application Ser. No. 62/300,011, filed on Feb. 25, 2016, the entire contents of which are hereby incorporated by reference.

FIELD OF THE INVENTION

The present invention is directed to a shoe rack, and in particular to a collapsible shoe rack, the size of which can be easily and significantly minimized when not in use.

BACKGROUND OF THE INVENTION

It is generally known to attach various article holding devices, such as shoe racks, over a top edge of a household door to gain additional storage spaces. Door-mounted shoe racks are popular items since they represent a relatively simple way to create additional space in a closet or other room. Numerous shoe rack designs have been presented, however, many conventional racks have arms that project outwards but do not fold up, requiring the rack to take up a lot of space even when not in use or when in transport. In addition, the crossbars of non-folding racks can interfere with the storage of taller items such as boots. Thus, various foldable shoe racks have been developed.

U.S. Pat. No. 7,762,406 to Qiang discloses a modular folding shoe rack that includes first and second side rails; first and second arms pivotably connected with the side rails at a first end of the arms; a first crossbar connected with the opposite ends of the arms; and a second crossbar connected with the side rails. Each side rail may also include complementary male/female connectors at its opposite ends to allow for connection of one side rail to another, resulting in a modular design. Even though the shoe rack in the '406 patent is foldable, the folded shoe rack is still bulky and takes a substantial size of the space, which is not easy to store or transport the shoe rack, even after it is folded.

U.S. Pat. No. 8,636,156 to Malik discloses a rack for storing objects on a door that has at least two uprights, at least two hanging brackets, a plurality of shelf supports, a plurality of shelves and at least two hanging links. The uprights are spaced apart a distance equal to a length of the shelves and spaced from the door by ends of the uprights angled toward the door. The shelves may be disposed at an angle relative to a vertical position of the uprights wherein a superior mounted pair of uprights has hanging links depending from a lower support end and the hanging links are engaged upon an upper support end of another pair of uprights. However, like the foldable shoe rack in the '406 patent, the reconfigurable rack in the '156 patent still takes a lot of spaces to store or transport, even though the size of which is reconfigurable.

Therefore, there remains a need for a new and improved collapsible shoe rack that is more convenient and efficient for the user to store or transport to overcome the problems presented above.

SUMMARY OF THE INVENTION

It is an object of the present invention to provide a collapsible shoe rack that can be stored and transported more conveniently and efficiently without putting any additional or unnecessary burden on the users.

It is another object of the present invention to provide a collapsible shoe rack which can be easily extended to use and restored when not in use.

It is a further object of the present invention to provide a collapsible shoe rack, which can be quickly collapsed on the ground, and the size of which can be significantly reduced.

In one aspect, a collapsible shoe rack may include a plurality of shoe retaining members having two parallel side arms integratedly connected with a horizontal arm; a plurality of connecting members to pivotally connect to different portions of the shoe retaining members; and a base. In one embodiment, the shoe retaining members are arranged in a reverse U-shaped manner in the shoe rack, and each shoe retaining members is connected with one or more the connecting members on each side arm. The shoe retaining member is disposed tiltedly and spacedly from another shoe retaining members in a parallel manner. The connecting member is also a U-shaped unit including two parallel connecting arms integratedly connected with a horizontal connecting arm, and the connecting members are also arranged in a parallel manner, so when the shoe rack is collapsed, the size of the shoe rack can be significantly reduced because the shoe retaining members can all be stacked up as well as all connecting members to minimize the occupied space.

In one embodiment, the connecting member is configured to pivotally connect with one or more shoe retaining members. For example, a first connecting portion on the connecting arm of a first connecting member is pivotally connected with a distal end of the side arm of a first shoe retaining member; a second connecting portion on the connecting arm of the first connecting member is pivotally connected with a center portion of the side arm of a second shoe retaining member; and a third connecting portion on the connecting arm of the first connecting member is pivotally connected with a top portion of the side arm of a third shoe retaining member. It is noted that the connection of the first connecting member and the shoe retaining members is identical on both sides of the shoe retaining member.

Similarly, a first connecting portion on the connecting arm of a second connecting member is pivotally connected with a distal end of the side arm of the shoe retaining member; a second connecting portion on the connecting arm of the second connecting member is pivotally connected with a center portion of the side arm of the third shoe retaining member; and a third connecting portion on the connecting arm of the second connecting member is pivotally connected a locking unit near the base of the collapsible shoe rack.

More specifically, one end of the locking unit is pivotally connected to the base while the other end thereof is pivotally connected to the third connecting portion on the connecting arm of the second connecting member 12. Since the collapsible shoe rack are made by a plurality of shoe retaining members and connecting members that are pivotally connected with each other in predetermined portions thereof, the locking unit is configured to lock the entire structure of shoe rack to prevent it from collapsing. More specifically, when the locking unit is operated in a clockwise manner to become substantially parallel to the side arm, the structure of the shoe rack.

The shoe retaining member may include a cross bar located at a center portion of the shoe retaining member. More specifically, both ends of the cross bar are connected with the center portions of both side arms of the shoe retaining member. In one embodiment, the cross bar is used to support the shoes placed on. It is noted that a connecting unit is used to pivotally connect the center portion of the first shoe retaining member and the top portion of the second shoe retaining member.

When the user wants to collapse the shoe rack, he/she can simply release the locking member by rotating it in a counter-clockwise manner, and the entire shoe rack structure can be collapsed by simply pushing it down. The locking member can continue to move in a counter-clockwise manner until it again becomes substantially parallel to the side arm, and meanwhile the shoe rack can be entirely collapsed.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

Figure 6:
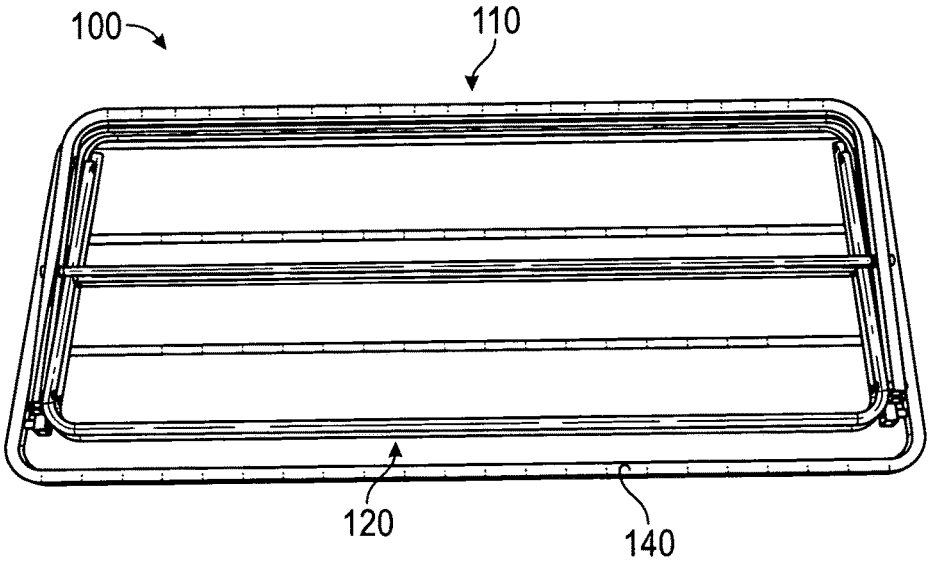
FIG. 6 illustrates a schematic view of the collapsible shoe rack in the present invention when it is totally collapsed.

In order to further understand the goal, characteristics and effect of the present invention, a number of embodiments along with the drawings are illustrated as following:

In one aspect, a collapsible shoe rack 100 may include a plurality of shoe retaining members 110 having two parallel side arms 111 integratedly connected with a horizontal arm 112; a plurality of connecting members 120 to pivotally connect to different portions of the shoe retaining members 110; and a base 140. In one embodiment, the shoe retaining members 110 are arranged in a reverse U-shaped manner in the shoe rack 100, and each shoe retaining members 110 is connected with one or more the connecting members 120 on each side. The shoe retaining member 110 is disposed tiltedly and spacedly from another shoe retaining members 110 in a parallel manner. The connecting member 120 is also a U-shaped unit including two parallel connecting arms 121 integratedly connected with a horizontal connecting arm 122, and the connecting members 120 are also arranged in a parallel manner, so when the shoe rack 100 is collapsed, the size of the shoe rack 100 can be significantly reduced as shown in FIG. 6 because the shoe retaining members 110 can all be stacked up as well as all connecting members 120 to minimize the occupied space.

Figure 1:
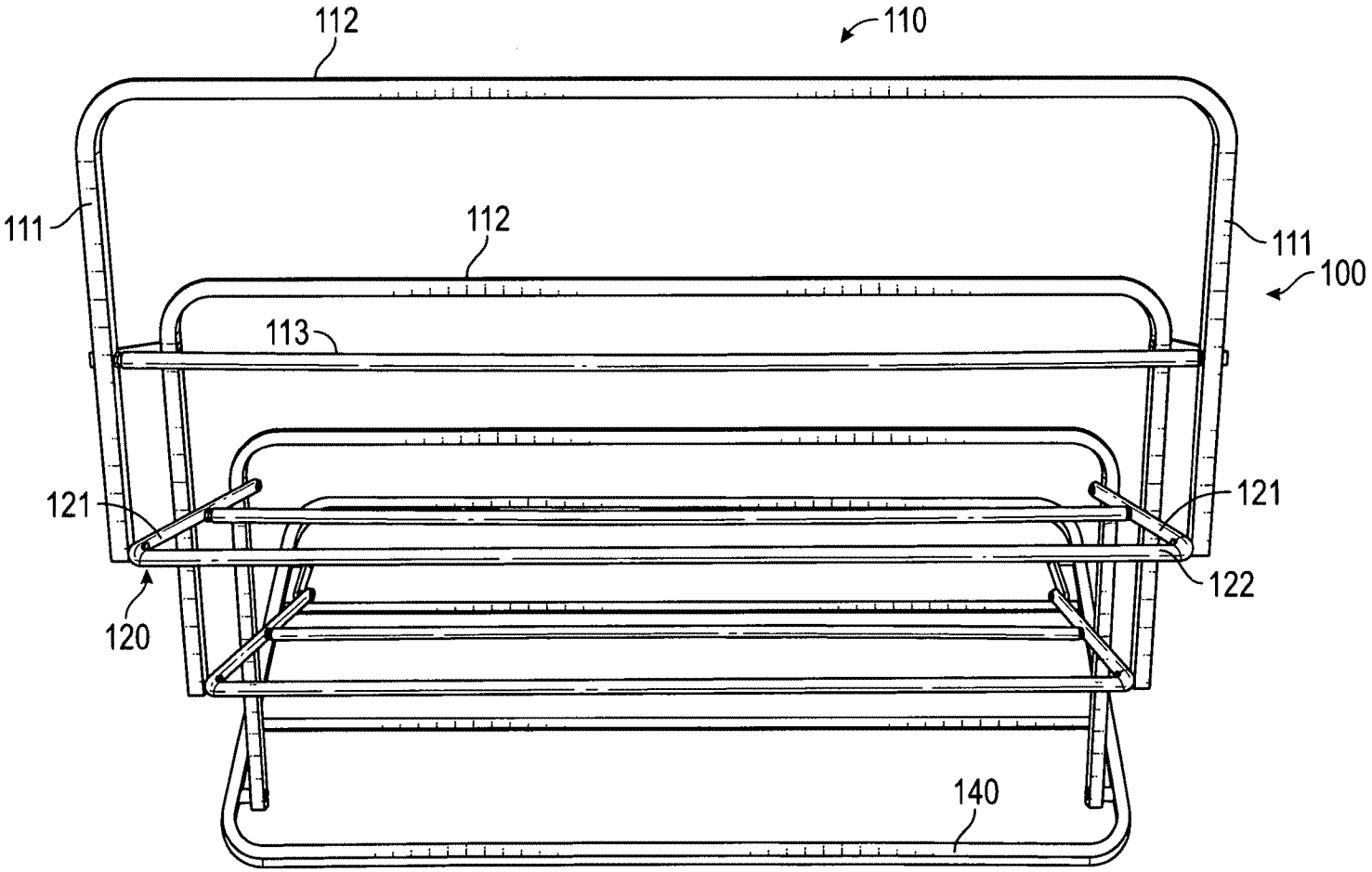
FIG. 1 illustrates a schematic view of the collapsible shoe rack in the present invention.
Figure 2:
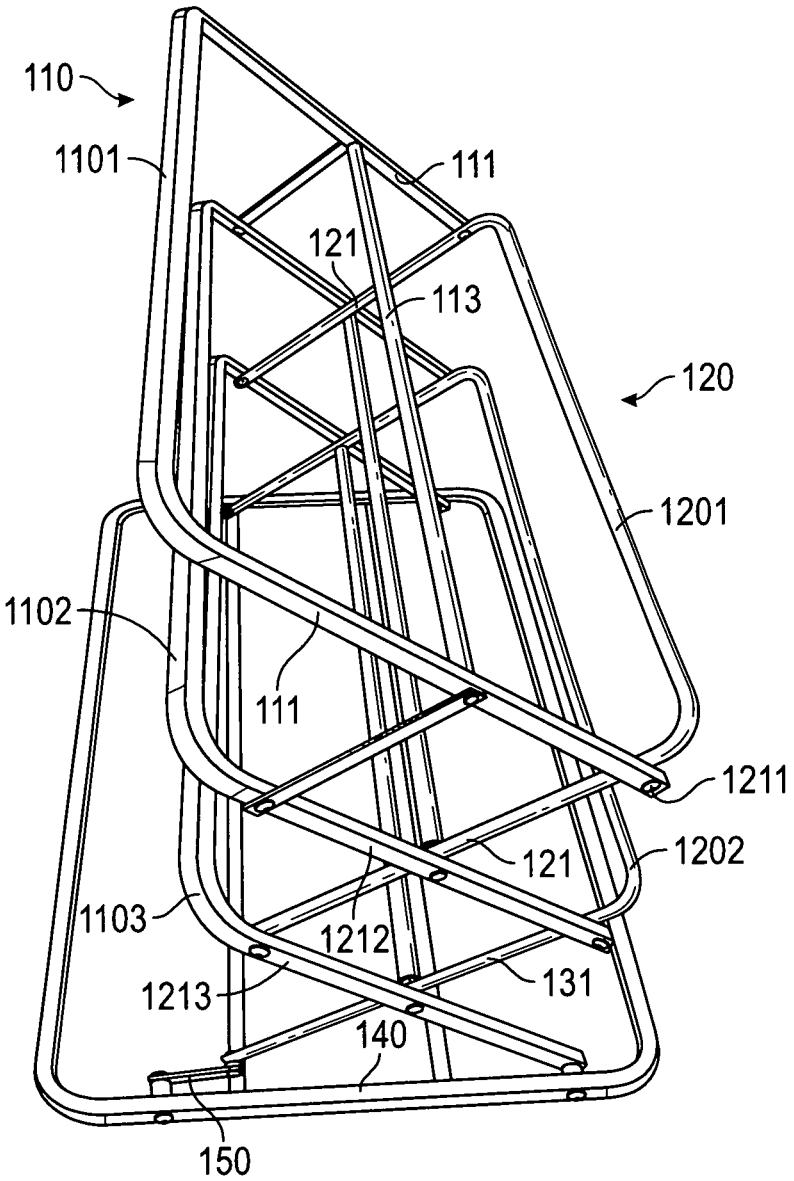
FIG. 2 illustrates a lateral perspective view of the collapsible shoe rack in the present invention.

In one embodiment, as shown in FIGS. 1 and 2, the connecting member 120 is configured to pivotally connect with one or more shoe retaining members 110. For example, a first connecting portion 1211 on the connecting arm 121 of a first connecting member 1201 is pivotally connected with a distal end of the side arm 111 of a first shoe retaining member 1101; a second connecting portion 1212 on the connecting arm 121 of the first connecting member 1201 is pivotally connected with a center portion of the side arm 111 of a second shoe retaining member 1102; and a third connecting portion 1213 on the connecting arm 121 of the first connecting member 1201 is pivotally connected with a top portion of the side arm 111 of a third shoe retaining member 1103. It is noted that the connection of the first connecting member 1201 and the shoe retaining members 1101 to 1103 is identical on both sides of the shoe retaining members.

Similarly, a first connecting portion 1211 on the connecting arm 121 of a second connecting member 1202 is pivotally connected with a distal end of the side arm 111 of the second shoe retaining member 1102; a second connecting portion 1212 on the connecting arm 121 of the second connecting member 1202 is pivotally connected with a center portion of the side arm 111 of the third shoe retaining member 1103; and a third connecting portion 1213 on the connecting arm 121 of the second connecting member 1202 is pivotally connected a locking unit 150 near the base 140 of the collapsible shoe rack 100.

Figure 3:
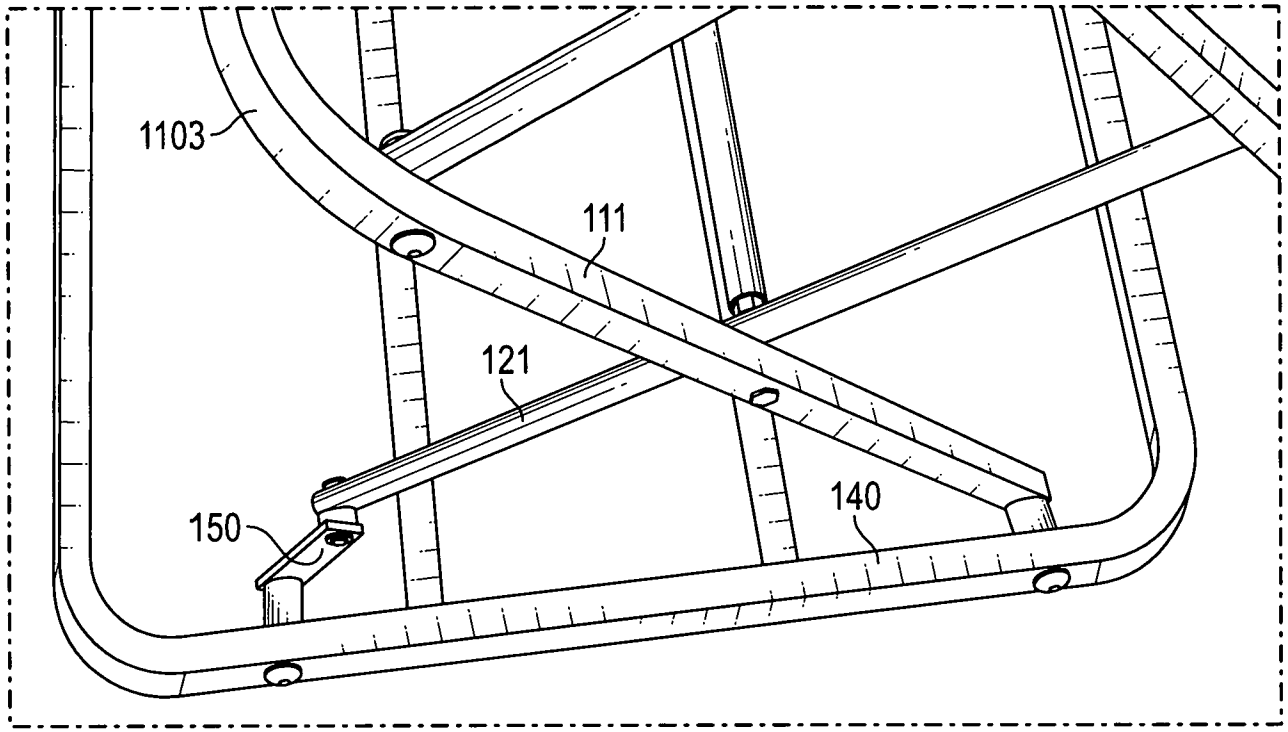
FIGS. 3 and 4 illustrate a schematic view of the lower portion of the collapsible shoe rack in the present invention.

More specifically, one end of the locking unit 150 is pivotally connected to the base 140 while the other end thereof is pivotally connected to the third connecting portion 1213 on the connecting arm 121 of the second connecting member 1202 as shown in FIGS. 2 and 3. Since the collapsible shoe rack 100 are made by a plurality of shoe retaining members 110 and connecting members 120 that are pivotally connected with each other in predetermined portions thereof, the locking unit 150 is operated in a 180 degree range and configured to lock the entire structure of shoe rack 100 to prevent it from collapsing. More specifically, when the locking unit 150 is operated in a clockwise manner to become substantially parallel to the side arm 111, the structure of the shoe rack 100 is locked as shown in FIG. 3.

The shoe retaining member 110 may include a cross bar 113 parallel to the horizontal arm 112 and located at a center portion of the shoe retaining member 110. More specifically, both ends of the cross bar 113 are connected with the center portions of the side arms 111. In one embodiment, the cross bar 113 is used to support the shoes placed on. It is noted that a connecting unit 123 is used to pivotally connect the center portion of the first shoe retaining member 1101 and the top portion of the second shoe retaining member 1102.

Figure 4:
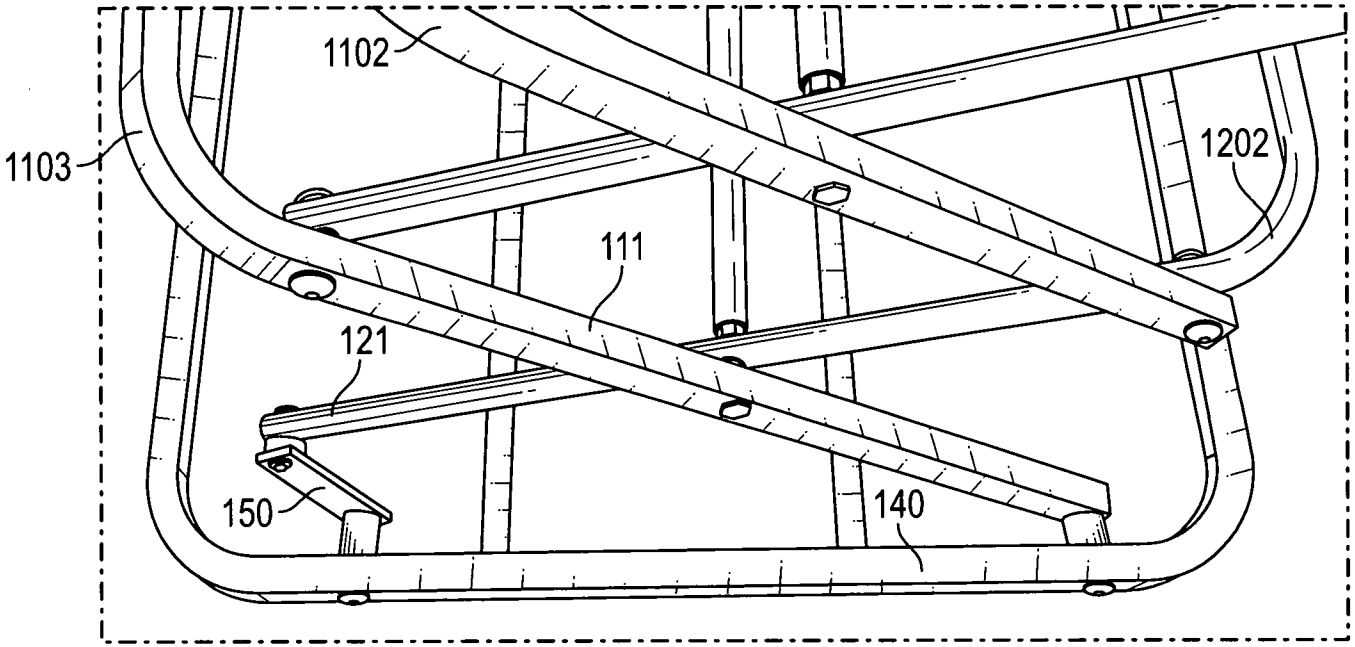
Figure 5:
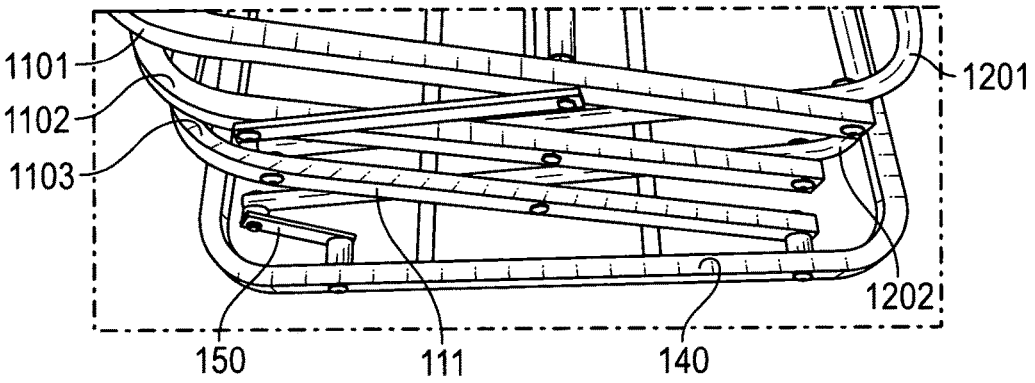
FIG. 5 illustrates a schematic view of the collapsible shoe rack in the present invention when it is partially collapsed.

When the user wants to collapse the shoe rack 100, he/she can simply release the locking member 150 by rotating it in a counter-clockwise manner as shown in FIG. 3, and the entire shoe rack structure can be collapsed by simply pushing it down as shown in FIGS. 4 and 5. The locking member 150 can continue to move in a counter-clockwise manner until it again becomes substantially parallel to the side arm 111 as shown in FIG. 5, and meanwhile the shoe rack 100 can be entirely collapsed as shown in FIG. 6.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A collapsible shoe rack comprising:

a base;

a locking unit;

a plurality of shoe retaining members having two parallel side arms integratedly connected with a horizontal arm; and a plurality of U-shaped connecting members arranged in a parallel manner to pivotally connect to different portions on the side arms of the shoe retaining members, each connecting member including two parallel connecting arms integratedly connected with a horizontal connecting arm;

wherein each shoe retaining member is U-shaped, disposed tiltedly and spacedly from other shoe retaining members in a parallel manner, and connected with one or more the connecting members on each side arm, wherein a first connecting portion on the connecting arm of a first connecting member is pivotally connected with a distal end of the side arm of a first shoe retaining member; a second connecting portion on the connecting arm of the first connecting member is pivotally connected with a center portion of the side arm of a second shoe retaining member; and a third connecting portion on the connecting arm of the first connecting member is pivotally connected to a top portion of a third shoe retaining member;

wherein one end of the locking unit is pivotally and undetachably to the base while the other end thereof is pivotally and undetachably connected to one connecting arm of a second connecting member, and the locking unit is operable in a 180-degree range to lock the shoe rack from collapsing.

2. The collapsible shoe rack of claim 1, wherein each shoe retaining member includes a cross bar parallel to the horizontal arm to support the shoes disposed thereon.

3. The collapsible shoe rack of claim 1, wherein a first connecting portion on the connecting arm of the second connecting member is pivotally connected with a distal end of the side arm of the second shoe retaining member; a second connecting portion on the connecting arm of the second connecting member is pivotally connected with a center portion of a side arm of the third shoe retaining member; and a third connecting portion on the connecting arm of the second connecting member is pivotally and undetachably connected with the locking unit.

4. The collapsible shoe rack of claim 1, wherein when the locking unit is operated in a clockwise manner to become substantially parallel to the side arm to lock the shoe rack.

* * * * *